United States Patent [19]

Castegnier

[11] Patent Number: 4,680,097

[45] Date of Patent: Jul. 14, 1987

[54] METHOD OF PREVENTING UNDESIRABLE GAS GENERATION BETWEEN ELECTRODES OF AN ELECTROCOAGULATION PRINTING SYSTEM

[75] Inventor: Adrien Castegnier, Outremont, Canada

[73] Assignee: Elcorsy Inc., St. Laurent, Canada

[21] Appl. No.: 909,729

[22] Filed: Sep. 22, 1986

[51] Int. Cl.[4] ..... C25D 13/04; C25D 13/18; C25D 13/20

[52] U.S. Cl. ..... 204/180.1; 204/2; 204/73 R; 204/180.2; 204/180.9; 204/299 R

[58] Field of Search ..... 204/180.1, 180.2, 180.9, 204/2, 73 R, 181.6, 299 PE, 299 R, 300 EC, 181.7, 181.5, 181.4, 181.3, 181.2, 181.1; 430/52, 38

[56] References Cited

U.S. PATENT DOCUMENTS

| | | | |
|---|---|---|---|
| 3,752,746 | 8/1973 | Castegnier | 204/2 X |
| 3,892,645 | 7/1975 | Castegnier | 204/180.2 |
| 4,555,320 | 11/1985 | Castegnier | 204/180.2 |

*Primary Examiner*—John F. Niebling
*Assistant Examiner*—John S. Starsiak, Jr.
*Attorney, Agent, or Firm*—Schwartz, Jeffery, Schwaab, Mack, Blumenthal & Evans

[57] ABSTRACT

The invention is concerned with a method of preventing undesirable gas generation between a pair of opposite, electrically energized negative and positive electrodes spaced from one another by a gap filled with an aqueous electrolyte solution. According to the invention, the positive electrode is coated with an olefinic substance to form micro-droplets thereof on the surface of the positive electrode prior to electrically energizing the electrodes such that upon electrical energization hydrogen generated as a result of electrolysis is consumed by reaction with the olefinic substance to convert same by hydrogenation into an ethylenically saturated product, the hydrogenation reaction being carried out in the presence of a metallic oxide catalyst. In this manner, undesirable hydrogen generation and accumulation at the negative electrode is prevented. The method of the invention is particularly useful in electrocoagulation printing systems where an image is reproduced by electrocoagulation of an electrolytically coagulable colloid on a positive electrode to form dots of coagulated colloid representative of a desired image, the invention enabling the electrical resistance which is created at the interface of the negative electrode by the accumulation of hydrogen and causes an erratic formation of the dots of coagulated colloid to be suppressed.

20 Claims, No Drawings

METHOD OF PREVENTING UNDESIRABLE GAS GENERATION BETWEEN ELECTRODES OF AN ELECTROCOAGULATION PRINTING SYSTEM

BACKGROUND OF THE INVENTION

The present invention relates to improvements in the field of electrocoagulation. More particularly, the invention is concerned with an improved method of reproducing an image by the electrocoagulation of an electrolytically coagulable colloid.

Applicant has already described in his U.S. Pat. No. 3,892,645 of July 1, 1975 an electrocoagulation printing method and system in which a thin layer of a liquid composition containing a colloid such as gelatin or albumin, water and an electrolyte is interposed between at least one pair of opposite negative and positive electrodes spaced from one another to define a gap which is filled by the liquid composition. In one embodiment, there is a plurality of electrically-insulated juxtaposed negative electrodes and selected ones thereof are electrically energized to pass electric pulses through the layer at selected points to cause point-by-point selective coagulation and adherence of the colloid in variable thickness on the positive electrode directly opposite each energized negative electrode, thereby forming dots of coagulated colloid representative of a desired image which may be transferred onto an end-use support, such as paper.

A major problem encountered with such an electrocoagulation printing method is that since the negative electrodes are generally energized more than once in the reproduction of an image, these become polarized resulting in secondary electrolytic reactions causing the generation of hydrogen bubbles which remain trapped at the interface of the negative electrodes and thus adversely affect the image reproduction. It has been observed that when forming the first series of dots of coagulated colloid there is no such undesirable gas generation and accumulation at the negative electrodes, but after the first electrocoagulation hydrogen generated by electrolysis slowly builds up and creates an electrical resistance at the interface of the negative electrodes such as to cause the formation of the dots of coagulated colloid to become erratic.

SUMMARY OF THE INVENTION

It is therefore an object of the present invention to overcome the above drawback and to provide a method of preventing undesirable gas generation between electrodes of, for instance, an electrocoagulation printing system.

According to a broad aspect of the invention, there is provided a method of preventing undesirable gas generation between a pair of opposite, electrically energized negative and positive electrodes spaced from one another by a gap filled with an aqueous electrolyte solution, which comprises coating the positive electrode with an olefinic substance to form micro-droplets thereof on the surface of the positive electrode prior to electrically energizing the electrodes such that upon electrical energization hydrogen generated as a result of electrolysis is consumed by reaction with the olefinic substance to convert same by hydrogenation into an ethylenically saturated product, the hydrogenation reaction being carried out in the presence of a metallic oxide catalyst. In this manner, undesirable hydrogen generation and accumulation at the negative electrode is prevented.

The method of the invention is particularly useful in electrocoagulation printing systems where an image is reproduced by electrocoagulation of an electrolytically coagulable colloid on a positive electrode to form dots of coagulated colloid representative of a desired image, the invention enabling the electrical resistance which is created at the interface of the negative electrode by the accumulation of hydrogen and causes an erratic formation of the dots of coagulated colloid to be suppressed.

The present invention therefore also provides, in another aspect thereof, an improved method of reproducing an image by electrocoagulation of an electrolytically coagulable colloid, wherein a layer of an aqueous colloidal dispersion containing an electrolytically coagulable colloid, water and a soluble electrolyte is interposed between at least one pair of opposite, electrolytically inert negative and positive electrodes spaced from one another by a gap filled with the aqueous colloidal dispersion and the electrodes are electrically energized to pass electric current through the layer at selected points to cause point-by-point selective coagulation and adherence of the colloid on the positive electrode and formation of a series of corresponding dots of coagulated colloid representative of a desired image, the improvement residing in coating the positive electrode with an olefinic substance to form micro-droplets thereof on the surface of the positive electrode prior to electrically energizing the electrodes such that upon electrical energization hydrogen generated as a result of electrolysis is consumed by reaction with the olefinic substance to convert same by hydrogenation into an ethylenically saturated product, the hydrogenation reaction being carried out in the presence of a metallic oxide catalyst, thereby preventing undesirable hydrogen generation and accumulation at the negative electrode.

It has been surprisingly found, according to the invention, that by coating the positive electrode with an olefinic substance undesirable hydrogen generation and accumulation at the negative electrode is prevented as the hydrogen is consumed by an hydrogenation reaction with the olefinic substance whereby the latter is converted into an ethylenically saturated product, provided that the hydrogenation reaction be carried out in the presence of a metallic oxyde catalyst which is either already present as a surface layer on the positive electrode utilized or is admixed with the olefinic substance.

It is also important that the coating of olefinic substance on the surface of the positive electrode be in the form of micro-droplets of the olefinic substance rather than a continuous film thereof which would otherwise create an electrical insulation preventing the passage of electric current. Such micro-droplets may have, for instance, a size ranging from about 2 to about 10$\mu$.

The micro-droplets of olefinic substance do not in any way affect the precision or resolution of the dots of coagulated colloid, nor do they slow down in any way the speed of electrocoagulation. In fact, it has been observed that the dots of coagulated colloid which are formed by the electrocoagulation carried out with micro-droplets of olefinic substance on the positive electrode have an increased optical density.

Examples of suitable olefinic substances which may be used according to the invention include unsaturated fatty acids such as arachidonic acid, linoleic acid, linolenic acid, oleic acid and palmitoleic acid, unsaturated vegetable oils such as corn oil, linseed oil, olive oil, peanut oil and soybean oil, and unsaturated vegetable waxes such as carnauba wax. Where an unsaturated vegetable wax is used, it is generally mixed with an unsaturated fatty acid such as oleic or linoleic acid to form a paste for application onto the positive electrode, orit may be liquefied by heat and applied as a liquid.

Since the metal of the positive electrode is not easily wetted by the unsaturated fatty acids which are liquid at room temperature, or by the unsaturated vegetable oils or waxes, micro-droplets of the olefinic substance can be readily formed on the surface of the positive electrode by applying the olefinic substance bymeans of a cloth impregnated with the latter.

It has been observed that when an unsaturated fatty acid such as linoleic or oleic acid is used as the olefinic substance and where the positive electrode utilized is made of stainless steel having a chromium oxide surface layer, the chromium oxide in the surface layer of the electrode is sufficient to act as the metallic oxide catalyst for hydrogenating the unsaturated fatty acid to a saturated fatty acid. Thus, no additional metallic oxide catalyst is necessary. However, when it is desired to reproduce half-tones, a metallic oxide catalyst is usually admixed with the unsaturated fatty acid for obtaining an image reproduction of high quality.

Examples of suitable metallic oxide catalysts which may be used according to the invention include aluminum oxide, ceric oxide, chromium oxide, curpric oxide, cuprous oxide, ferric oxide, ferrous oxide, lead oxide, magnesium oxide, manganese oxide, and zinc oxide. Ferric oxide is the preferred metallic oxide catalyst.

When the olefinic substance is an unsaturated vegetable oil, it is advantageously applied to the positive electrode in the form of a dispersion containing the metallic oxide catalyst. The metallic oxide catalyst is preferably present in an amount of about 1 to about 10% by weight, based on the total weight of the dispersion. Particularly preferred dispersion are those containing about 88 wt.% of an unsaturated vegetable oil such as olive oil, corn oil or peanut oil, about 2 wt.% of oleic acid and about 10 wt.% of ferric oxide.

The method according to the invention not only prevents undesirable gas generation between electrodes of an electrocoagulation printing system, but also greatly facilitates the transfer of the coagulated colloid onto an end-use support when the dots of coagulated colloid are contacted with an end-use support to imprint the latter with the image reproduced. Indeed, by using as olefinic substance an unsaturated vegetable oil, the micro-droplets of vegetable oil are converted upon hydrogenation into micro-droplets of fat weakening the adherence of the dots of coagulated colloid to the positive electrode and thereby facilitating the transfer of the coagulated colloid onto the end-use support upon contact therewith.

After electrocoagulation and transfer of the coagulated colloid onto an end-use support, the micro-droplets of fat or other ethylenically saturated product which remain on the positive electrode can be removed by cleaning the surface of the electrode with an organic solvent such as acetone, petroleum ether or toluene, or with any commercially available detergent solution.

The following non-limiting examples illustrate the invention.

EXAMPLE 1

An electrocoagulation printing system according to one of the embodiments described in Applicant's U.S. Pat. No. 3,892,645 was used. In such an embodiment, a positive electrode in the form of a revolving cylinder having a cylindrical surface made of stainless steel is partially immersed in a bath containing an electrolytically coagulable colloid, water and a soluble electrolyte and maintained at substantially constant temperature, the stainless steel having a surface layer of chromium oxide. The printing head which is operative to form dots of coagulated colloid on the surface of the positive electrode comprises a plurality of electrically-insulated juxtaposed negative electrodes spaced from the positive electrode surface by a substantially constant electrode gap of the order of 50μ.

Prior to immersing the cylinder into the bath containing the aqueous colloidal dispersion, the cylindrical surface was coated with oelic acid to form thereon micro-droplets of unsaturated fatty acid. After immersion into the bath, the oleic acid coated cylinder was set into revolving motion to fill the electrode gap with the aqueous colloidal dispersion. Selected ones of the negative electrodes were then electrically energized to cause point-by-point selective coagulation and adherence of the colloid onto the positive electrode surface, thereby forming a series of corresponding dots of coagulated colloid representative of a desired image.

During the electrocoagulation, no undesirable hydrogen generation and accumulation at the negative electrodes could be observed. The resulting dots of coagulated colloid were also easily transferrable onto an end-use support, such as paper.

EXAMPLE 2

Example 1 was repeated, except that the oelic acid was replaced by linoleic acid. Essentially the same results were obtained.

EXAMPLE 3

Example 1 was repeated, except that the surface of the positive electrode was coated with a dispersion containing about 88 wt.% olive oil, about 2 wt.% oleic acid and about 10 wt.% ferric acid. Essentially the same results were obtained.

A conversion of the vegetable oil into fat was also observed.

EXAMPLE 4

Example 1 was repeated, except that the surface of the positive electrode was coated with a dispersion containing about 88 wt.% corn oil, about 2 wt.% oleic acid and about 10 wt.% ferric oxide. Essentially the same results were obtained.

EXAMPLE 5

Example 1 was repeated, except that the surface of the positive electrode was coated with a dispersion containing about 95 wt.% oleic acid and about 5 wt.% ferric oxide. Essentially the same results were obtained.

Particularly favorable results were obtained when using as electrolytically coagulable colloid a linear polyacrylamide having a molecular weight of about 250,000 and sold under the trademark ACCOSTRENGTH 86 by Cyanamid Inc.

Moreover, dots of coagulated colloid could be formed at a rate of about 2,000,000 per second, with half-tones being clearly reproduced.

COMPARATIVE EXAMPLE 1

The procedure of example 1 was followed, except that the oleic acid was replaced by liquefied lauric acid, a saturated fatty acid. About 7 wt.% ferric oxide was admixed with the lauric acid. Upon repeated electrical energization of the same negative electrodes, there was observed a generation of hydrogen bubbles which remained trapped at the interface of the negative electrodes and thus hindered the image reproduction.

COMPARATIVE EXAMPLE 2

The procedure of Example 1 was repeated, except that the surface of the positive electrode was coated with a dispersion containing about 90 wt.% mineral oil and about 10 wt.% ferric oxide. The same results as in Comparative Example 1 were obtained.

I claim:

1. A method of preventing undesirable gas generation between a pair of opposite, electrically energized negative and positive electrodes spaced from one another by a gap filled with an aqueous electrolyte solution, which comprises coating the positive electrode with an olefinic substance to form micro-droplets thereof on the surface of the positive electrode prior to electrically energizing said electrodes such that upon electrical energization gas generated as a result of electrolysis is consumed by reaction with said olefinic substance, said reaction being carried out in the presence of a metallic oxide catalyst, thereby preventing undesirable gas generation between said electrodes.

2. A method as claimed in claim 1, wherein said olefinic substance is selected from the group consisting of unsaturated fatty acids, unsaturated vegetable oils and waxes.

3. A method as claimed in claim 2, wherein said olefinic substance is an unsaturated fatty acid selected from the group consisting of arachidonic acid, linoleic acid, linolenic acid, oleic acid and palmitoleic acid.

4. A method as claimed in claim 2, wherein said olefinic substance is an unsaturated vegetable oil selected from the group consisting of corn oil, linseed oil, olive oil, peanut oil and soybean oil.

5. A method as claimed in claim 3, wherein said unsaturated fatty acid is linoleic or oleic acid and wherein said positive electrode is made of stainless steel having a chromium oxide surface layer, said chromium oxide acting as said metallic oxide catalyst.

6. A method as claimed in claim 1, wherein said olefinic substance is an unsaturated vegetable oil and is applied to said positive electrode in the form of a dispersion containing said metallic oxide catalyst.

7. A method as claimed in claim 6, wherein said metallic oxide catalyst is present in an amount of about 1 to about 10% by weight, based on the total weight of said dispersion.

8. A method as claimed in claim 6, wherein said metallic oxide catalyst is selected from the group consisting of aluminum oxide, ceric oxide, chromium oxide, cupric oxide, cuprous oxide, ferric oxide, ferrous oxide, lead oxide, magnesium oxide, manganese oxide and zinc oxide.

9. A method as claimed in claim 8, wherein said dispersion contains about 88 wt.% of an unsaturated vegetable oil selected from the group consisting of olive oil, corn oil and peanut oil, about 2 wt.% of oleic acid and about 10 wt.% of ferric oxide.

10. In a method of reproducing an image by electrocoagulation of an electrolytically coagulable colloid, wherein a layer of an aqueous colloidal dispersion containing an electrolytically coagulable colloid, water and a soluble electrolyte is interposed between at least one pair of opposite, electrolytically inert negative and positive electrodes spaced from one another by a gap filled with said aqueous colloidal dispersion and said electrodes are electrically energized to pass electric current through the layer at selected points to cause point-by-point selective coagulation and adherence of the colloid on the positive electrode and formation of a series of corresponding dots of coagulated colloid representative of a desired image, the improvement which comprises coating the positive electrode with an olefinic substance to form micro-droplets thereof on the surface of the positive electrode prior to electrically energizing said electrodes such that upon electrical energization hydrogen generated as a result of electrolysis is consumed by reaction with said olefinic substance, said reaction being carried out in the presence of a metallic oxide catalyst, thereby preventing undesirable hydrogen generation and accumulation at the negative electrode.

11. A method as claimed in claim 10, wherein said olefinic substance is selected from the group consisting of unsaturated fatty acids, unsaturated vegetable oils and waxes.

12. A method as claimed in claim 11, wherein said olefinic substance is an unsaturated fatty acid selected from the group consisting of arachidonic acid, linoleic acid, linolenic acid, oleic acid and palmitoleic acid.

13. A method as claimed in claim 11, wherein said olefinic substance is an unsaturated vegetable oil selected from the group consisting of corn oil, linseed oil, olive oil, peanut oil and soybean oil.

14. A method as claimed in claim 12, wherein said unsaturated fatty acid is linoleic or oleic acid and wherein said positive electrode is made of stainless steel having a chromium oxide surface layer, said chromium oxide acting as said metallic oxide catalyst.

15. A method as claimed in claim 10, wherein said olefinic substance is an unsaturated vegetable oil and is applied to said positive electrode in the form of a dispersion containing said metallic oxide catalyst.

16. A method as claimed in claim 15, wherein said metallic oxide catalyst is present in an amount of about 1 to about 10% by weight, based on the total weight of said dispersion.

17. A method as claimed in claim 15, wherein said metallic oxide catalyst is selected from the group consisting of aluminum oxide, ceric oxide, chromium oxide, cupric oxide, cuprous oxide, ferric oxide, ferrous oxide, lead oxide, magnesium oxide, manganese oxide and zinc oxide.

18. A method as claimed in claim 17, wherein said dispersion contains about 88 wt.% of an unsaturated vegetable oil selected from the group consisting of olive oil, corn oil and peanut oil, about 2 wt.% of oleic acid and about 10 wt.% of ferric oxide.

19. A method as claimed in claim 10, wherein said dots of coagulated colloid are contacted with an end-use support to cause transfer of the coagulated colloid onto said end-use support and thereby imprint said end-use support with said image, and wherein said olefinic substance is an unsaturated vegetable oil such that upon reaction the micro-droplets of vegetable oil are converted into micro-droplets of fat weakening the adherence of said dots of coagulated colloid to said positive electrode and thereby facilitating the transfer of said coagulated colloid onto said end-use support upon contact therewith.

20. A method as claimed in claim 12, wherein said positive electrode is made of stainless steel having a chromium oxide surface layer, and wherein said unsaturated fatty acid is oleic acid and is applied in the form of a dispersion containing ferric oxide as said metallic oxide catalyst, said electrolytically coagulable colloid comprising a linear polyacrylamide having a molecular weight of about 250,000.

* * * * *

UNITED STATES PATENT AND TRADEMARK OFFICE

CERTIFICATE OF CORRECTION

PATENT NO. : 4,680,097

DATED : July 14, 1987

INVENTOR(S) : Adrien CASTEGNIER

It is certified that error appears in the above-identified patent and that said Letters Patent is hereby corrected as shown below:

In column 5:

line 30, delete "gas" and insert --hydrogen--;

line 31, after "substance" insert --to convert same by hydrogenation into an ethylenically saturated product--;
after "said" (second occurrence) insert --hydrogenation--;

line 33, delete "gas" and insert --hydrogen--;

line 34, delete "between said electrodes" and insert --and accumulation at the negative electrode--;

line 51, after "catalyst" insert --for hydrogenating said unsaturated fatty acid to a saturated fatty acid--.

In column 6:

line 22, after "substance" insert --to convert same by hydrogenation into an ethylenically saturated product--;
after "said" (second occurrence) insert --hydrogenation--;

line 42, after "catalyst" insert --for hydrogenating said unsaturated fatty acid to a saturated fatty acid--;

UNITED STATES PATENT AND TRADEMARK OFFICE

CERTIFICATE OF CORRECTION

PATENT NO. : 4,680,097

DATED : July 14, 1987

INVENTOR(S) : Adrien Castegnier

It is certified that error appears in the above-identified patent and that said Letters Patent is hereby corrected as shown below:

line 68, delete "reaction" and insert --hydrogenation--.

Signed and Sealed this

Nineteenth Day of July, 1988

*Attest:*

DONALD J. QUIGG

*Attesting Officer*

*Commissioner of Patents and Trademarks*